US006082664A

United States Patent [19]

Phelps et al.

[11] Patent Number: 6,082,664

[45] **Date of Patent: *Jul. 4, 2000**

[54] CORELESS ROLL PRODUCT AND ADAPTER

[75] Inventors: Stephen L. Phelps, Lilburn; Richard P. Lewis; Ernest P. Sedlock, both of Marietta, all of Ga.

[73] Assignee: Kimberly-Clark Worldwide, Inc., Neenah, Wis.

[ * ] Notice: This patent issued on a continued prosecution application filed under 37 CFR 1.53(d), and is subject to the twenty year patent term provisions of 35 U.S.C. 154(a)(2).

[21] Appl. No.: 08/975,175

[22] Filed: Nov. 20, 1997

[51] Int. Cl.[7] ..... B65H 16/06; B65H 19/00

[52] U.S. Cl. ..... 242/596.5; 242/560; 242/561; 242/596.7; 242/599.3

[58] Field of Search ..... 242/560, 561, 242/596, 596.5, 596.7, 599.3

[56] References Cited

U.S. PATENT DOCUMENTS

| | | | |
|---|---|---|---|
| Re. 25,828 | 8/1965 | Wooster . | |
| D. 238,462 | 1/1976 | Bauman . | |
| D. 238,466 | 1/1976 | Bauman | D6/97 |

(List continued on next page.)

FOREIGN PATENT DOCUMENTS

| | | |
|---|---|---|
| 833971 | 2/1970 | Canada . |
| 928671 | 6/1973 | Canada . |
| 2190806 | 6/1997 | Canada . |
| 0089933 A1 | 9/1983 | European Pat. Off. . |
| 0618159A2 | 2/1994 | European Pat. Off. . |
| 0589481 A1 | 3/1994 | European Pat. Off. . |
| 0608046 A1 | 7/1994 | European Pat. Off. . |
| 0698367A1 | 2/1996 | European Pat. Off. . |
| 0729724A1 | 9/1996 | European Pat. Off. . |
| 0842881A2 | 5/1998 | European Pat. Off. . |
| 2251202 | 6/1975 | France . |
| 1194670 | 12/1962 | Germany . |
| 1248002 | 9/1971 | United Kingdom . |
| 2120206 | 11/1983 | United Kingdom . |
| 2 244 472A | 12/1992 | United Kingdom . |
| 2276107 | 9/1994 | United Kingdom . |
| 2 294 681 | 5/1996 | United Kingdom . |

(List continued on next page.)

OTHER PUBLICATIONS

JP 8196469 A (Abstract Only); Assignee: Sekisui Chem Ind Co. Ltd.; Mar. 4, 1991.

JP 8333041 A (Abstract Only); Assignee: Taisei Tekkosho KK; Dec. 17, 1996.

JP 8333055 A (Abstract Only); Assignee; Uchinami KK; Dec. 17, 1906.

JP 9118455 A (Abstract Only); Assignee: Taisei Tekkosho KK; May 6, 1997.

JP 9216755 A (Abstract Only); Assignee: Yamazaki T; Aug. 19, 1997.

JP 9323849 A (Abstract Only); Assignee: Taisei Tekkosho KK; Dec. 16, 1997.

TW 293002 A (Abstract Only); Assignee: Minnesota Mining & Mfg. Co.; Dec. 11, 1996.

*Primary Examiner*—Donald P. Walsh
*Assistant Examiner*—William A. Rivera
*Attorney, Agent, or Firm*—Dority & Manning, P.A.

[57] ABSTRACT

Adapters for solid or coreless rolls of material dispensed in a roll dispenser, which may have slots defined on the side walls thereof. The adapters may have a base body with a first side disposable adjacent to the roll and a second side disposable adjacent to the side walls of the dispenser. A protrusion may extend substantially transverse from the first side and may have a shape and length so as to extend at least partially into a recess or divot formed in the vertical sides of the rolls. An engaging member may extend substantially transverse from the second side of the body member and may have a shape and a length so as to be insertable into and slidable along slots disposed in the dispenser. A pair of the adapters may engage and hold the roll therebetween within the dispenser and may allow for the roll to move along the slots defined in the dispenser to a dispensing position.

18 Claims, 5 Drawing Sheets

U.S. PATENT DOCUMENTS

| | | | |
|---|---|---|---|
| D. 316,201 | 4/1991 | Shimasaki . | |
| D. 318,770 | 8/1991 | Grisel . | |
| D. 327,798 | 7/1992 | Addison et al. . | |
| 390,084 | 9/1888 | Lane . | |
| 419,811 | 1/1890 | Zerr . | |
| 498,900 | 6/1893 | Hicks . | |
| 1,217,211 | 2/1917 | Pico . | |
| 1,229,431 | 6/1917 | Farrell . | |
| 1,778,282 | 10/1930 | Stewart . | |
| 2,049,964 | 8/1936 | Lawson . | |
| 2,232,968 | 2/1941 | Price et al. . | |
| 2,276,414 | 3/1942 | Morehouse et al. . | |
| 2,299,626 | 10/1942 | Hunt . | |
| 2,308,840 | 1/1943 | Vaughan et al. . | |
| 2,380,644 | 7/1945 | Grondona . | |
| 2,390,399 | 12/1945 | Tator et al. . | |
| 2,555,885 | 6/1951 | Hope . | |
| 2,566,883 | 9/1951 | Gove . | |
| 2,583,411 | 1/1952 | Carlin . | |
| 2,643,069 | 6/1953 | Carlin . | |
| 2,695,208 | 11/1954 | Graham . | |
| 2,726,823 | 12/1955 | Jespersen . | |
| 2,790,608 | 4/1957 | Sieven . | |
| 2,819,852 | 1/1958 | Sarro . | |
| 2,830,775 | 4/1958 | Kiesel . | |
| 2,839,346 | 6/1958 | Lawalin . | |
| 2,845,231 | 7/1958 | Grettve . | |
| 2,849,191 | 8/1958 | Gadler . | |
| 2,872,263 | 2/1959 | Andersson . | |
| 2,873,158 | 2/1959 | Pinkham, Jr. . | |
| 2,879,012 | 3/1959 | Sarro . | |
| 2,905,404 | 9/1959 | Simmons . | |
| 2,939,645 | 6/1960 | Rowlands et al. . | |
| 2,946,636 | 7/1960 | Penney . | |
| 3,004,693 | 10/1961 | Johnson . | |
| 3,029,035 | 4/1962 | Layton . | |
| 3,032,283 | 5/1962 | Wooster . | |
| 3,034,739 | 5/1962 | Barger . | |
| 3,038,598 | 6/1962 | Layton et al. . | |
| 3,045,939 | 7/1962 | Vander Waal . | |
| 3,084,006 | 4/1963 | Roemer . | |
| 3,333,909 | 8/1967 | Beker . | |
| 3,580,651 | 5/1971 | Gauper . | |
| 3,729,145 | 4/1973 | Koo et al. . | |
| 3,791,601 | 2/1974 | Broden . | |
| 3,794,253 | 2/1974 | Megdall . | |
| 3,799,467 | 3/1974 | Bauman . | |
| 3,802,639 | 4/1974 | Dowd, Jr. . | |
| 3,823,887 | 7/1974 | Gerstein . | |
| 3,826,361 | 7/1974 | Heckrodt . | |
| 3,830,143 | 8/1974 | Dowd, Jr. . | |
| 3,853,279 | 12/1974 | Gerstein . | |
| 3,856,226 | 12/1974 | Dowd, Jr. . | |
| 3,878,998 | 4/1975 | Lazzari . | |
| 4,013,236 | 3/1977 | Perrin . | |
| 4,013,240 | 3/1977 | Ferrin . | |
| 4,032,077 | 6/1977 | Baselice . | |
| 4,113,195 | 9/1978 | Theunissen . | |
| 4,191,307 | 3/1980 | LeCaire, Jr. et al. . | |
| 4,274,573 | 6/1981 | Finkelstein . | |
| 4,289,262 | 9/1981 | Finkelstein . | |
| 4,297,403 | 10/1981 | Smith . | |
| 4,314,679 | 2/1982 | Paul et al. . | |
| 4,383,656 | 5/1983 | Campbell . | |
| 4,410,221 | 10/1983 | Vallis et al. . | |
| 4,467,974 | 8/1984 | Crim . | |
| 4,487,378 | 12/1984 | Kobayashi . | |
| 4,513,923 | 4/1985 | Ulics . | |
| 4,535,947 | 8/1985 | Hidle . | |
| 4,583,642 | 4/1986 | Blythe et al. . | |
| 4,614,312 | 9/1986 | Del Pino . | |
| 4,634,067 | 1/1987 | White . | |
| 4,659,028 | 4/1987 | Wren . | |
| 4,662,576 | 5/1987 | Paul . | |
| 4,667,890 | 5/1987 | Gietman, Jr. . | |
| 4,695,005 | 9/1987 | Gietman, Jr. . | |
| 4,757,952 | 7/1988 | Balzer . | |
| 4,760,970 | 8/1988 | Larsson et al. . | |
| 4,767,075 | 8/1988 | Peters et al. . | |
| 4,783,015 | 11/1988 | Shimizu . | |
| 4,792,105 | 12/1988 | Imaseki . | |
| 4,807,825 | 2/1989 | Elsner et al. . | |
| 4,821,974 | 4/1989 | Poehlein . | |
| 4,832,271 | 5/1989 | Geleziumas . | |
| 4,860,893 | 8/1989 | Kaufman | 200/390 |
| 5,065,924 | 11/1991 | Granger | 225/46 |
| 5,097,998 | 3/1992 | Shimasaki . | |
| 5,100,075 | 3/1992 | Morand . | |
| 5,161,793 | 11/1992 | Lotto et al. | 271/182 |
| 5,170,938 | 12/1992 | Dewing . | |
| 5,170,958 | 12/1992 | Brown . | |
| 5,197,727 | 3/1993 | Lotto et al. | 271/183 |
| 5,205,455 | 4/1993 | Moody | 225/106 |
| 5,215,211 | 6/1993 | Eberle | 221/1 |
| 5,219,126 | 6/1993 | Schutz . | |
| 5,253,818 | 10/1993 | Craddock . | |
| 5,271,137 | 12/1993 | Schutz | 29/400.1 |
| 5,271,575 | 12/1993 | Weinert . | |
| 5,277,375 | 1/1994 | Dearwester . | |
| 5,281,386 | 1/1994 | Weinert . | |
| 5,310,129 | 5/1994 | Whittington et al. . | |
| 5,314,131 | 5/1994 | McCanless et al. . | |
| 5,352,319 | 10/1994 | Ishizu et al. | 156/446 |
| 5,362,013 | 11/1994 | Gietman, Jr. et al. . | |
| 5,366,175 | 11/1994 | Schutz . | |
| 5,370,336 | 12/1994 | Whittington . | |
| 5,370,339 | 12/1994 | Moody et al. . | |
| 5,372,865 | 12/1994 | Arakawa et al. . | |
| 5,385,318 | 1/1995 | Rizzuto . | |
| 5,386,950 | 2/1995 | Abt . | |
| 5,387,284 | 2/1995 | Moody . | |
| 5,390,875 | 2/1995 | Gietman, Jr. et al. . | |
| 5,402,960 | 4/1995 | Oliver . | |
| 5,407,509 | 4/1995 | Ishizu et al. | 156/184 |
| 5,421,536 | 6/1995 | Hertel et al. . | |
| 5,439,187 | 8/1995 | Shimizu . | |
| 5,451,013 | 9/1995 | Schutz . | |
| 5,453,070 | 9/1995 | Moody . | |
| 5,467,935 | 11/1995 | Moody . | |
| 5,467,936 | 11/1995 | Moody . | |
| 5,474,436 | 12/1995 | Yamazaki . | |
| 5,480,060 | 1/1996 | Blythe | 221/63 |
| 5,495,997 | 3/1996 | Moody . | |
| 5,497,959 | 3/1996 | Johnson et al. . | |
| 5,501,415 | 3/1996 | Harris et al. . | |
| 5,505,402 | 4/1996 | Vigneau . | |
| 5,513,478 | 5/1996 | Abt | 53/118 |
| 5,518,200 | 5/1996 | Kaji et al. | 252/538.1 |
| 5,538,199 | 7/1996 | Biagiotti . | |
| 5,542,622 | 8/1996 | Biagiotti . | |
| 5,577,686 | 11/1996 | Moody . | |
| 5,597,135 | 1/1997 | Vandersteene . | |
| 5,603,467 | 2/1997 | Perini et al. . | |
| 5,609,269 | 3/1997 | Behnke et al. . | |
| 5,611,455 | 3/1997 | McCreary | 221/45 |
| 5,618,008 | 4/1997 | Dearwester et al. . | |
| 5,620,148 | 4/1997 | Mitchell . | |
| 5,620,544 | 4/1997 | Cram et al. | 156/184 |
| 5,636,812 | 6/1997 | Conner et al. . | |
| 5,639,046 | 6/1997 | Biagiotti . | |
| 5,642,810 | 7/1997 | Warner et al. . | |
| 5,660,349 | 8/1997 | Miller et al. . | |

5,669,576 9/1997 Moody .
5,676,331 10/1997 Weber .
5,690,296 11/1997 Biagiotti .
5,697,576 12/1997 Bloch et al. .
5,722,608 3/1998 Yamazaki .
5,725,176 3/1998 Vigneau .
5,727,883 3/1998 Kusano et al. .
5,730,387 3/1998 Yamazaki .
5,746,379 5/1998 Shimizu .
5,794,882 8/1998 Lewis .
5,797,559 8/1998 Coffey .
5,839,680 11/1998 Biagiotti .
5,848,762 12/1998 Reinheimer et al. .
5,849,357 12/1998 Andersson .
5,868,275 2/1999 Moody .
5,868,342 2/1999 Moody et al. .
5,875,985 3/1999 Cohen et al. .
5,904,316 5/1999 Dunning et al. .

FOREIGN PATENT DOCUMENTS

93/10700 6/1993 WIPO .
93/21094 10/1993 WIPO .
94/29205 12/1994 WIPO .
WO 9427483 12/1994 WIPO .
95/01929 1/1995 WIPO .
WO 9508940 4/1995 WIPO .
95/13183 5/1995 WIPO .
96/28079 9/1996 WIPO .
WO 9626878 9/1996 WIPO .
WO 9627546 9/1996 WIPO .

CORELESS ROLL PRODUCT AND ADAPTER

BACKGROUND OF THE INVENTION

A recent development in the industry of rolled paper products is solid or "coreless" rolls of material, such as bathroom tissue paper. Generally speaking, these solid or coreless rolls are wound completely of the paper material and do not contain a hollow spindle or core of any type. A divot or recess may be formed in each side of the paper roll which define a rotational axis for the roll.

Dispensers for multiple rolls of paper material, such as rolls of bathroom tissue, are also well known in the art. With typical conventional dispensers of this type, two rolls of tissue are vertically oriented within the dispenser so that the top roll falls into a dispensing position when the bottom roll is depleted. Generally, these conventional dispensers are configured for conventional rolls incorporating a hollow core or spindle which extends through the rolls and into slots or pathways defined in the sides of the dispensers.

These conventional dispensers suffer the disadvantage of failing to dispense multiple rolls of the solid or coreless rolls because they do not hold the coreless rolls within the dispensers and maintain the rolls in proper alignment. Accordingly, a dispenser that addresses the problem of dispensing multiple solid or coreless rolls from a single dispenser will improve over conventional roll dispensers.

OBJECTS AND SUMMARY OF THE INVENTION

Objects and advantages of the invention will be set forth in part in the following description, or may be obvious from the description, or may be learned through practice of the invention.

The problems and needs described above are addressed by the present invention which provides adapters for solid or coreless rolls of paper material, such as bathroom tissue, that may be dispensed in a roll dispenser of the type having slots or pathways defined on side wall members thereof. The solid or coreless rolls may have recesses or divots defined in the vertical sides thereof that also may define a rotating axis for the solid or coreless rolls. Desirably, each adapter includes a base body having a first side disposable adjacent to the roll and a second side disposable adjacent to the side wall member of the dispenser. A protrusion may extend substantially transverse from the first side. Desirably, the protrusion has a shape and a length so as to extend at least partially into the recess formed in the side of the roll. An engaging member may extend substantially transverse from the second side of the body and has a shape and length so as to be insertable into and slidable within the slots defined in the side walls of the dispenser. Desirably, a pair of the adapters engage and hold the coreless roll within the roll dispenser and allow for the coreless rolls to move along the slots defined in the roll dispenser to a dispensing position. An advantage of the present invention is that the adapters permit multiple solid or coreless rolls of material to be dispensed by dispensers originally configured for conventional hollow core roll products. It is contemplated that configurations of the adapters may work with both hollow core rolls and solid or coreless rolls.

The adapters can take on various configurations and shapes. For example, in one embodiment, the base body, protrusion, and engaging member are formed as a single unitary component, for example a molded component.

In a desired embodiment, the base body may include first and second halves with a spring device disposed in a recess defined between the halves. Desirably, the second half defines a bearing surface which slides along structure in the dispenser defining the slots while the engaging member is disposed within the slot adjacent an opposite side of the structure. Thus, the structure may be sandwiched between the engaging member and spring loaded bearing surface of the body member's second half. In this embodiment, the engaging member may include a shaft section that may be connected to the first half with the second half being concentric about and movable along the shaft section. The engaging member also may include a flange member that may be configured to slide within the roll dispenser slot. The flange member may be oblong in shape and include radiused ends.

Desirably, the protrusion that may extend at least partially into the divot or recess defined in the side of the roll also includes a rolling surface against which the additional vertically disposed roll may rest and rolls within the dispenser once the first solid core roll held by the adapters has been used. In other words, once a first roll of material is depleted, desirably the second vertically oriented roll will fall into a dispensing position within the dispenser and the adapters will fall to the bottom of the dispenser slots and be retained therein until the cover of the dispenser is opened for replacement of the rolls. When the second roll falls into its dispensing position, the circumference of the roll will rest on and roll against the adapters, particularly on the rolling surface defined by the adapters. In one embodiment, the rolling surface may be generally horizontal and defines the protrusion member. In an alternative embodiment, the rolling surface may be conical in shape. Any number of various shapes and configurations may be used to define the rolling surfaces.

In a preferred embodiment, the protrusion may be centrally located on the body member and be coaxial to a longitudinal axis of the body member. In an alternative embodiment, the protrusion may be offset from the longitudinal axis of the adapter.

The present invention also may include a dispenser for storing and dispensing multiple rolls of a solid or coreless rolled material. Desirably, this dispenser includes a frame having side wall members, a front cover, and a dispensing opening on a front side thereof. The side wall members may have generally vertically oriented and oppositely facing slots or pathways defined on inside surfaces thereof. Desirably, adapters are provided and are removably insertable into the slots for holding the solid or coreless rolls therebetween in a vertically aligned orientation within the frame. The adapters are as described above.

Figure 1:
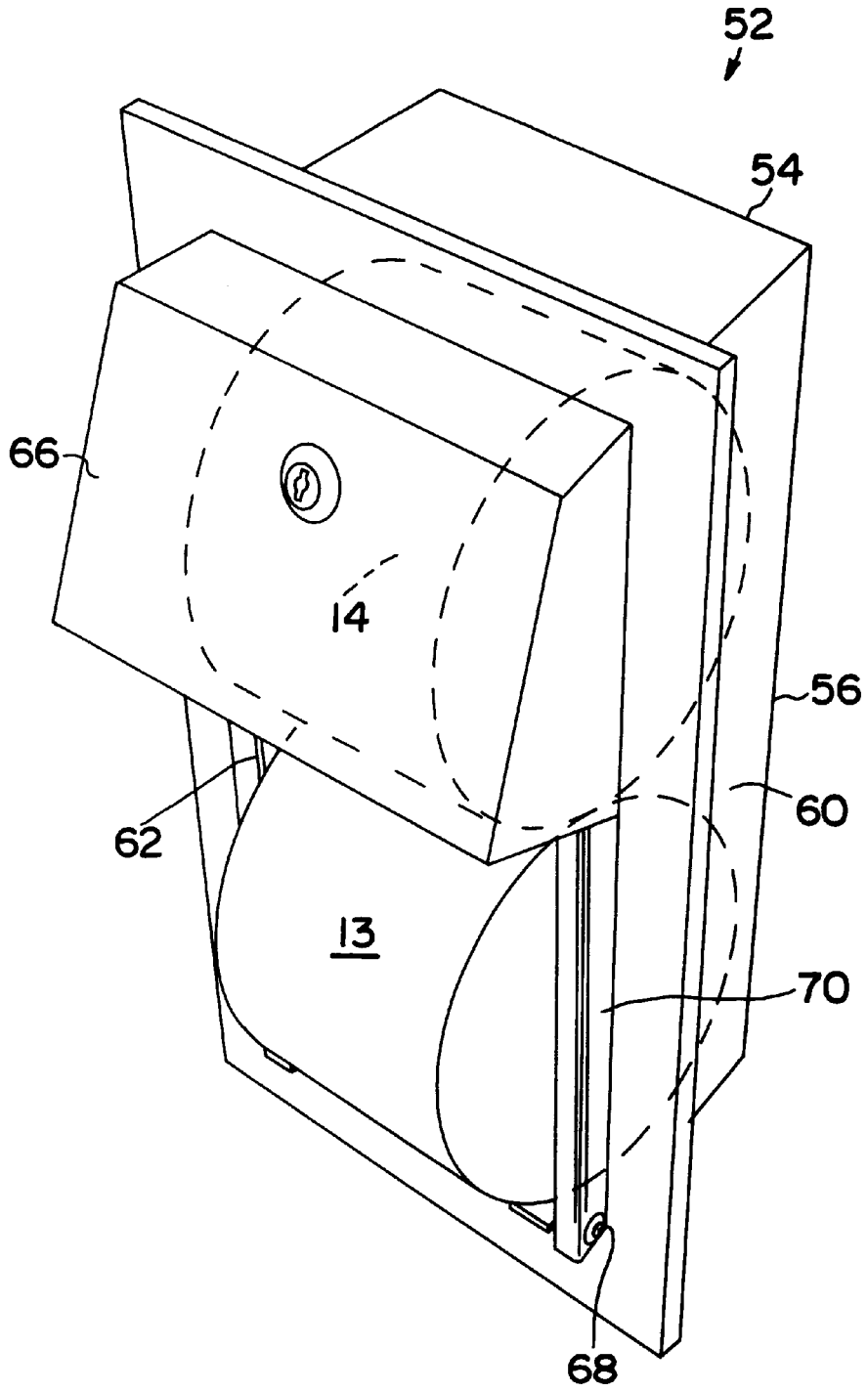
FIG. 1 is a perspective operational view of an exemplary multiple roll dispenser.

FIGS. **6*a*–6*f*** illustrate exemplary adapters.

DETAILED DESCRIPTION OF THE INVENTION

Reference will now be made in detail to various embodiments of the invention, one or more examples of which are illustrated in the drawings. Each example is provided by way of explanation of the invention, and not meant as a limitation of the invention. For example, features illustrated or described as part of one embodiment can be used in another embodiment to yield still a further embodiment. It is intended that the present invention cover such modifications and variations coming within the scope and spirit of the invention.

The present invention will be described and illustrated as it relates to solid or coreless rolls of bathroom tissue. However, it should be understood and appreciated that the present invention has uses in any application wherein solid or coreless rolls of material, and not necessarily paper material, are to be dispensed from a dispensing device. Some other materials include, for example, non-woven fabrics, films, textiles, screens, meshes, and composites or laminates including one or more of the above. The term "coreless" refers to rolls not having a hollow tube or core with a spindle device inserted therethrough. However, a solid or non-hollow core member is within the scope and spirit of the invention. The present invention is illustrated and described in relation to a dispenser for bathroom tissue only for illustrative purposes, and this should not be interpreted as a limitation of the invention.

Figure 2:
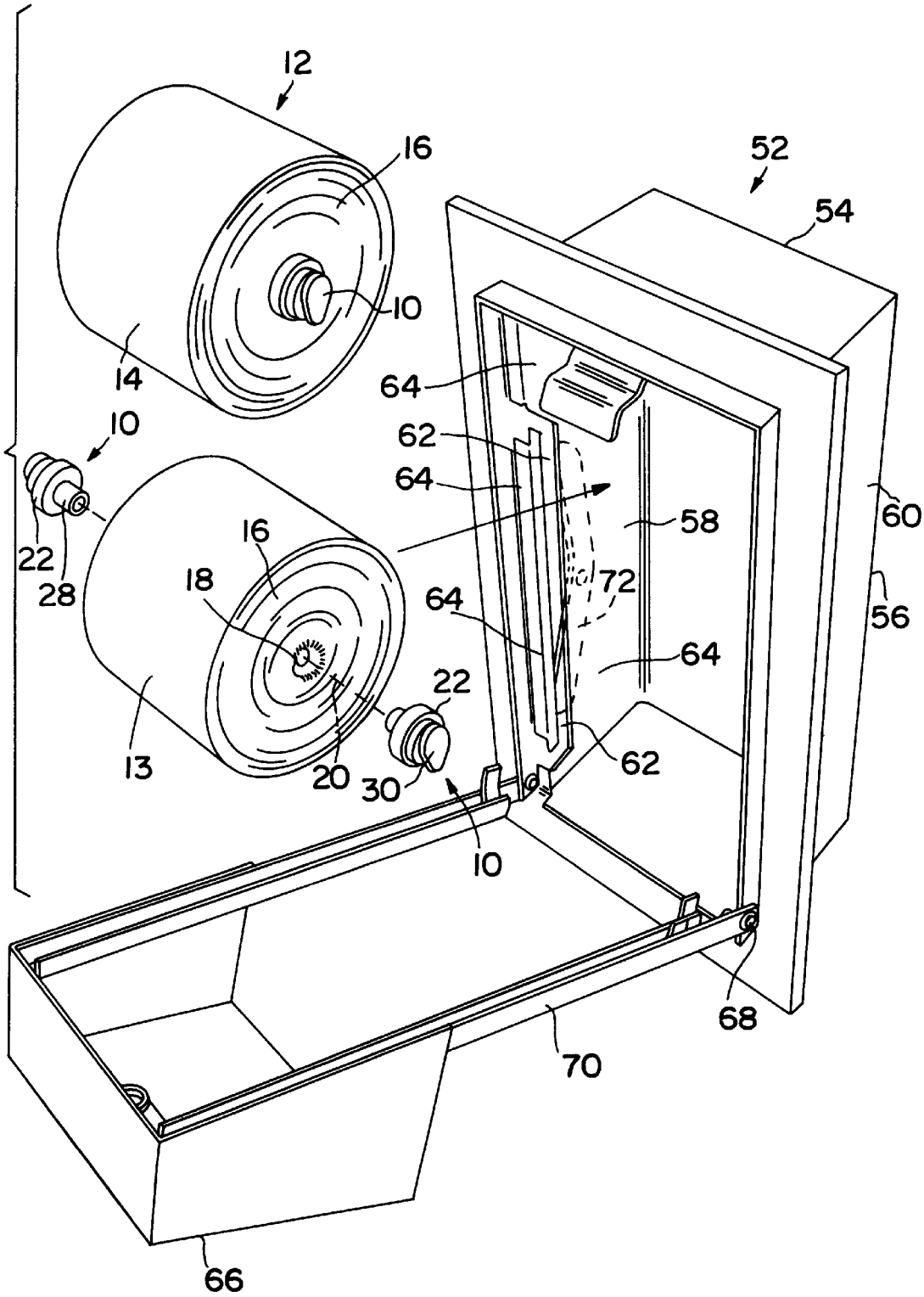
FIG. 2 is a view of the dispenser shown in FIG. 1 in its opened state and further illustrates exemplary adapters.
Figure 3:
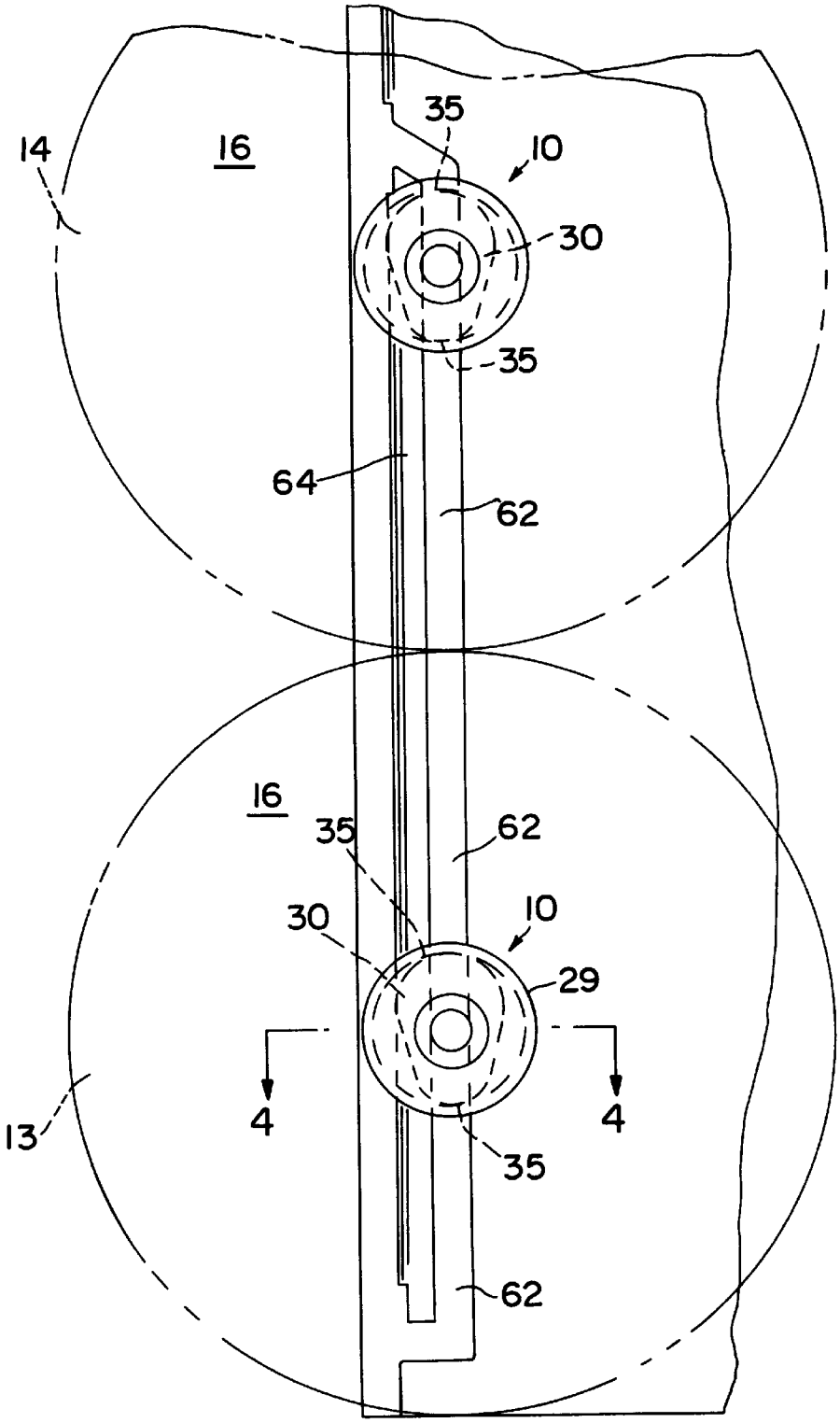
FIG. 3 is an enlarged view of a side wall of an exemplary dispenser particularly illustrating engagement of exemplary adapters within the dispenser slot.

FIG. 1 conceptually illustrates the present invention. An exemplary dispenser 52 is shown which is formed of a frame 54 having side walls 56. The side walls 56 may have an outer surface 60 and an inner surface 58 (FIG. 2). The dispenser 52 includes a front cover member 66 that pivots away from frame 54 at pivot points 68. Desirably, the cover member is a front cover. The cover 66 may include an opening defining the dispensing position of the lowermost roll and may further include vertical arms 70 that attach to frame 54 at pivot point 68. Alternatively, a bottom portion of the dispenser may contain an opening that defines the dispensing position for the lowermost roll. Desirably, the dispenser 52 includes vertically oriented and oppositely facing slots 62 disposed within the dispenser on the inside wall surfaces 58 (FIG. 2). The solid or coreless rolls of material 13, 14, are held within the dispenser by engagement of adapters 10 (FIG. 2) within slots 62, as will be described in more detail below.

A detailed explanation of the dispenser frame and components is not necessary for purposes of the present disclosure. Such conventional dispensers have typically been used to dispense multiple vertical rolls of tissue paper having hollow cores. A spindle device is inserted through the hollow cores and engages in each of the slots 62, as is well understood by those skilled in the art. One of the goals of the present invention is to configure the inventive adapters with such conventional dispensers. Examples of conventional dispensers that are useful in the present invention are manufactured by ASI of Yonkers, N.Y.; Bobrick of Los Angeles, Calif.; Bradley of Menomonee Falls, Wis.; and McKinney Essex of Scranton, Pa. The dispensers of these companies and others are all similar in operation in that they define slots or pathways on the inside surfaces of the side walls in order to load, store, and dispense rolls of bathroom tissue.

Referring to FIG. 2, the exemplary dispenser 52 is illustrated in more detail. A slot or pathway 62 is illustrated on the inside wall 58. The slot 62 may be formed by structure 64, such as sheet metal components. In the embodiment illustrated in FIG. 2, slot 62 is essentially straight and vertical. However, in various models of conventional dispensers, the slots can take on various orientations and include slanted or angled sections. Generally speaking, the slots allow for the loading of the material rolls at an upper end and guide the loaded material rolls along the slots to a dispensing position at the lower end, as understood by those skilled in the art.

Figure 5:
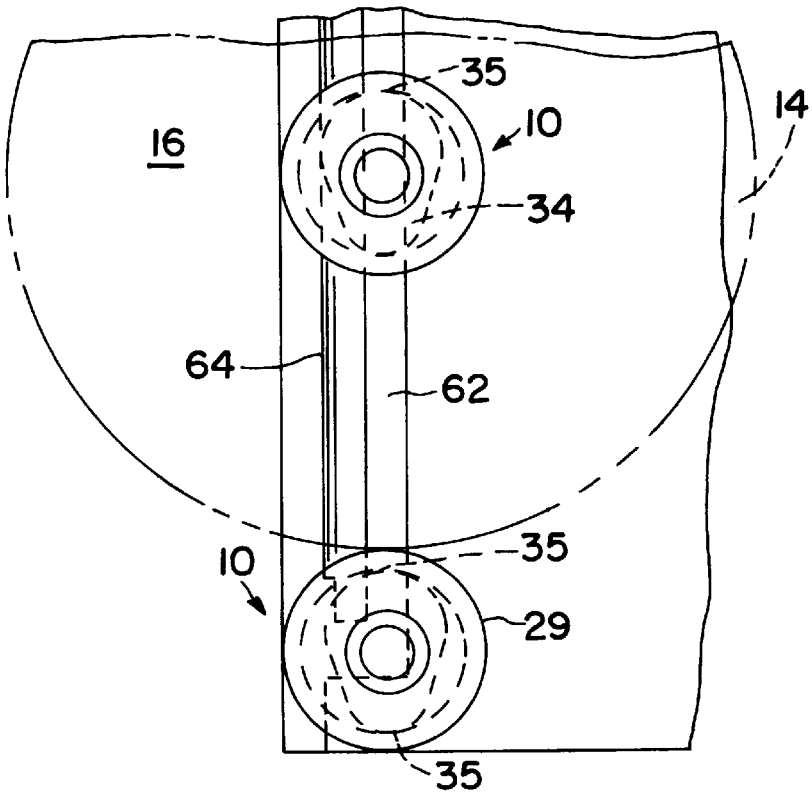
FIG. 5 is a perspective view illustrating the second roll once it has dropped into a dispensing position wherein it also rests and rolls against the adapters from the first roll.

Referring again to FIG. 2, a rocker arm 72 is illustrated as housed within the structure 64 defining slot 62. The operation of rocker arm 72 is also understood by those skilled in the art and generally serves to hold the upper roll of material 14 above the dispensing position of the lower roll, as shown in FIG. 1, until the lower roll has been depleted. Once the lower roll has been depleted, the adapters 10 slide downward to a lowermost position in the slots, as illustrated in FIG. 5, which allows rocker arm 72 to pivot and permit the upper roll of material 14 to fall into the dispensing position.

Referring to FIGS. 2 through 5, adapters 10 according to the invention may include a base body, generally 22. Desirably, base body 22 has a first side or face 24 that lies adjacent to the roll 13, and a second side or face 26 that may lie adjacent to the inside surface of the dispenser side walls or structure 64 defining the slot 62. A protrusion 28 may extend generally transversely from body member 22 and has a length and shape so as to extend at least partially into a divot or recess 18 defined in the vertical side of the rolls of material, as shown particularly in FIG. 4. The protrusion 28 can have any desired shape or configuration, as will be discussed in more detail below.

The adapter 10 may include an engaging member, generally 30, extending generally transversely from second side 26 of body member 22. The engaging member 30 desirably may include a flange member 34 having a shape so as to be insertable into slot 62. A desirable shape of flange member 34 is oblong with radiused ends 35. With this shape, adapters 10 can be inserted into slots 62 by placing the pointed or smaller radiused end 35 into the initial opening of the slot 62. The larger radiused end ensures that the adapter 10 is held within the slot 62. It should be appreciated, however, that the flange member 34 can take on any desired shape that facilitates loading of adapters 10 while ensuring that adapters 10 are securely held within slots 62.

Engaging members 30 also may include a shaft portion or section 32 that connects the flange member 34 to body member 22. The shaft section 32 may have a length and diameter to extend through the slot 62 and permit the adapter 10 to slide within the slot 62.

It should be appreciated by those skilled in the art that the particular dimensions of the adapter 10 will vary depending on the type of dispenser used. For example, the dimensions of the slot 62 will determine the diameter of shaft section 32. Likewise, the depth of the slot and thickness of the structure 64 forming the slot 62 will determine at least in part the length of shaft section 32. The width of the slot 62 will determine the shape and dimensions of the flange member 34. It is well within the purview of one skilled in the art to determine the optimal dimensions for adapters 10 depending on the type of dispenser the adapters are intended to be used with.

Figure 4:
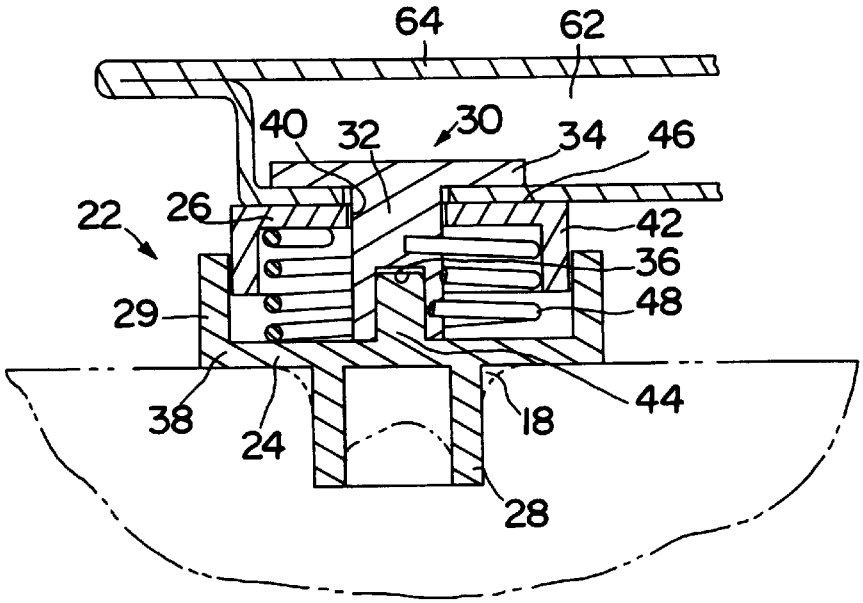
FIG. 4 is a cross-cut view taken along the lines indicated in FIG. 3 and particularly illustrates the components of an embodiment of the adapters.

FIG. 4 illustrates a desired embodiment of the adapter 10. In this embodiment, the base body 22 may include a first body half 38 and a second body half 42 that may be spring loaded against a first body half 38 by means of a spring 48 disposed in a recess defined between the two components. In this embodiment, the engaging member 30 may be non-movably fixed to the first body half 38. In the embodiment illustrated, a tab 44 may be defined on the first body half 38 and shaft section 32 of the engaging member 30 is press-fitted onto the tab 44. Alternatively, the shaft section 32 can be screwed, adhered, or otherwise connected to the first body half 38. The shaft section 32 extends through a hole 40 defined in the second body half 42. Thus, the second body half 42 may be spring loaded away from the first body half 32 against the flange member 34. In this manner, when the adapter 10 may be inserted into the slot 62, as particularly illustrated in FIG. 4, the structure 64 defining the slot 62 may be sandwiched between the flange member 34 and second body half 42. Thus, when the adapter 10 moves downward within the slot 62, the face of the second body member 42 may act as a sliding bearing surface against the structure 64. Likewise, the flange member 34 may also bear or slide against the structure 64. In this regard, the spring tension should not prevent easy sliding of the adapter 10 against the structure 64.

The embodiment illustrated in FIG. 4 is particularly useful in that it ensures that adapters 10 are held against the structure 64 so as to extend essentially transverse or horizontal from the slot 62. This is particularly important when the first roll 13 is depleted and the second roll 14 drops into its dispensing position, as illustrated in FIG. 5. Once this happens, the roll 14 will rest and roll against a rolling surface 29 of the lower set of adapters 10. In the embodiment illustrated, the rolling surface 29 may include the circumference of the body member 22 or the first body half 38, since this surface will move inward under the force of the spring 48 once roll 13 is depleted. The embodiment of FIG. 4 prevents the adapters 10 in this situation from canting downward or toeing-in which, if allowed to happen, would pinch the upper roll 14 and prevent the upper roll 14 from rolling freely within the dispenser. It should be appreciated that the same affect can be achieved if the length of the shaft section 32 were minimized. However, the length of the shaft section 32 will vary depending on the particular dispenser utilized. In this regard, the embodiment of FIG. 4 provides a more versatile adapter in that it can be used on various dispensers and, effectively, varies the shaft section 32.

As described above, FIG. 5 illustrates the condition wherein the first roll 13 has been depleted and the second roll 14 has dropped into a dispensing position. In this configuration, the first set of adapters 10 has dropped into a lowermost position within the slot 62. The flange member 34 should be of a shape and length to ensure that the adapter 10 remains held within the slot 62 and is not pushed out of the slot 62 by the rolling action of the upper roll 14. It is desired that adapters 10 are held in slots 62 until the front cover 66 of the dispenser 52 is opened, as illustrated in FIG. 2, at which time adapters 10 can be easily removed from the slot 62 for reuse.

Figure 6A:
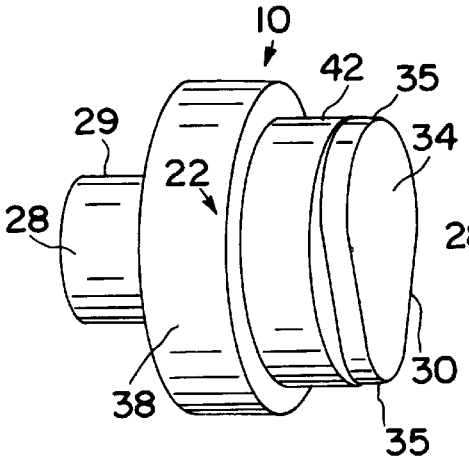
Figure 6B:
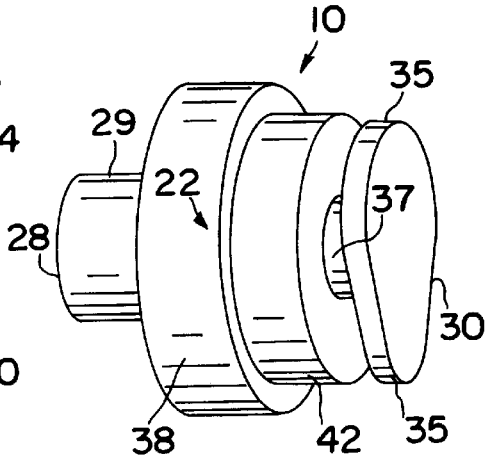

FIGS. 6*a* through 6*f* illustrate various embodiments of adapters 10 according to the invention. The embodiment illustrated in FIG. 6*a* is essentially the same as the device illustrated and described with respect to FIG. 4. The embodiment illustrated in FIG. 6*b* is similar to the embodiment of FIG. 6*a* with the exception that a shoulder 37 may be formed on the shaft section 32 to extend the length of the shaft section 32. In this embodiment, the second body half 42 may be spring loaded against the shoulder 37 instead of the flange member 34. Applicants have found that this embodiment is particularly useful on dispensers manufactured by Bobrick.

Figure 6C:
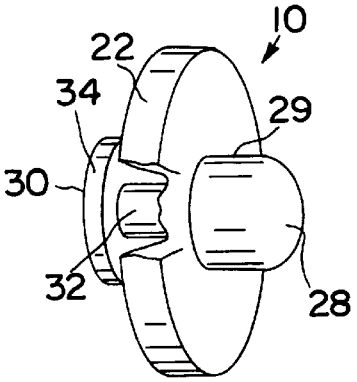

FIG. 6*c* illustrates an embodiment wherein the adapter 10 is formed as a single molded component. In this embodiment, the shaft section 32 may have a defined length. The protrusion 28 may have a rounded front end which permits easy rotation of the rolls relative to the adapters 10. The rolling surface 29 may be defined as the circumferential length of the protrusion 28.

Figure 6D:
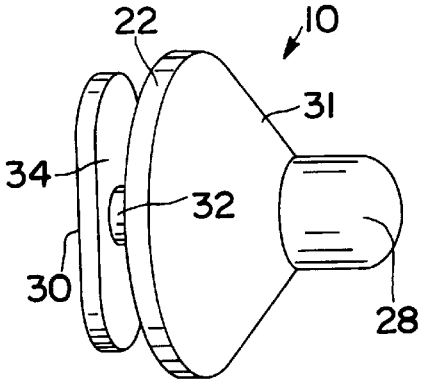

FIG. 6*d* illustrates an alternative embodiment of a unitary molded adapter 10. In this embodiment, the rolling surface may be defined as a conical surface 31 and the flange member 34 of the engaging member 30 may have an oblong shape.

Figure 6E:
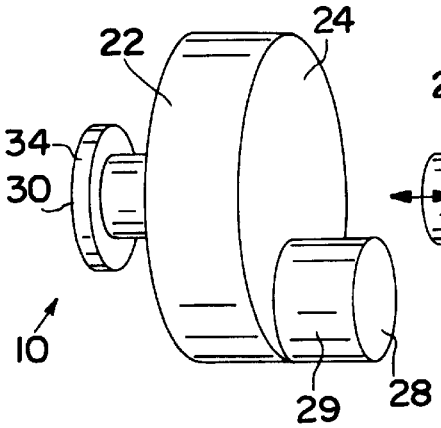

FIG. 6*e* illustrates an alternative embodiment wherein the protrusion 28 and rolling surface 29 may be offset from a longitudinal axis of the adapter 10. The longitudinal axis is generally defined as coinciding with the rotational axis of the rolls and is identified generally as the element 20 in FIG. 2. In the embodiment illustrated in FIG. 6*e*, when this adapter 10 has dropped into the position illustrated in FIG. 5, the upper roll 14 will rest on the rolling surface 29 and against the relatively elongated section of the front face 24, thus minimizing the toe-in condition.

Figure 6F:
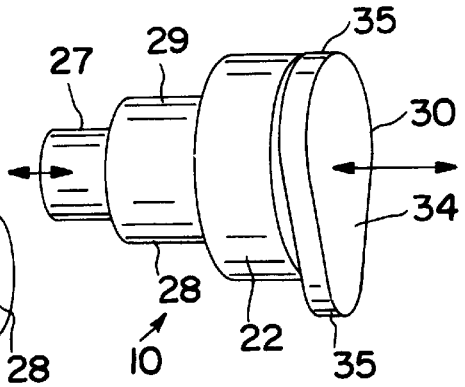

An alternative embodiment of a spring loaded adapter 10 is illustrated in FIG. 6*f*. In this embodiment, an engaging member 30 may include an elongated flange member 34 with radiused ends 35. The engaging member 30 may include a shaft 27 that may extend through a body member 22 and a protrusion 28. A spring (not illustrated) may be housed within the protrusion 28 and desirably spring loads the flange 34 against the body member 22. The flange 34 can be pulled away from the body member 22 in the direction of the arrows wherein the structure 64 defining the slot 62 may be sandwiched between the flange 34 and the body member 22 similar to the embodiment of FIG. 4. Depending on the degree of movement of the engaging member 30 away from the body member 22, the shaft 27 will act as an extension of the protrusion 28 and may extend into the divot or recess 18 in the roll.

It should be appreciated by those skilled in the art that various modifications and variations can be made in the present invention, particularly the configuration of the adapters. For example, any of the various features illustrated in the adapters can be interchanged to yield a multitude of differently configured adapters. Additionally, the present inventive adapters are described and illustrated as utilized in dispensers. It is within the scope and spirit of the invention that the adapters be used with any type of dispenser wherein multiple rolls of solid or coreless material are housed and moved therein to a dispensing position. The adapters are not limited to use with dispensers. It is intended that the present invention cover such modifications and variations as come within the scope and spirit of the appended claims and their equivalents.

What is claimed is:

1. An adapter for solid or coreless rolls of paper material that are dispensed in a roll dispenser having slots defined on side wall members thereof for receipt of said adapter, the solid or coreless rolls having recesses defined in sides thereof defining a rotating axis for said solid or coreless rolls, said adapter comprising:

a base body having a first side disposable adjacent said roll and a second side disposable adjacent said side wall member;

a protrusion extending substantially transverse from said first side, said protrusion having a shape and length so as to extend partially into one of said recesses formed in said rolls, said roll rotatable on said protrusion;

an engaging member extending substantially transverse from said second side and having a shape and length so as to be insertable into and slidable along said roll dispenser slots;

said base body comprising first and second halves with a spring device disposed therebetween, said second half defining said second side and spring loaded towards said engaging member so as to act as a bearing surface which slides along structure defining said roll dispenser slots, said engaging member disposable within said slot adjacent an opposite side of said structure; and wherein a pair of said adapters engage and hold said roll therebetween within said roll dispenser without contact of said protrusions and upon depletion of said roll said first halves move inward towards each other thereby preventing said adapters from canting relative to said slot.

2. The adapter as in claim 1, wherein said engaging member is non-movable relative to said first half, said second half being spring loaded against said engaging member.

3. The adapter as in claim 2, wherein said engaging member comprises a shaft section connected to said first half, said second half concentric about and movable along said shaft section, said engaging member further comprising a flange member configured to slide within said roll dispenser slot.

4. The adapter as in claim 3, wherein said flange member comprises an oblong member with radiused ends.

5. The adapter as in claim 1, wherein said protrusion further comprises a rolling surface against which an additional vertically disposed said roll of paper material rests and rolls within said roll dispenser once said first roll held by said adapters has been used.

6. The adapter as in claim 5, wherein said rolling surface is generally horizontal.

7. The adapter as in claim 5, wherein said rolling surface is generally conical.

8. The adapter as in claim 1, wherein said protrusion is essentially coaxial with a longitudinal axis through said adapter.

9. The adapter as in claim 1, wherein said protrusion is offset from a longitudinal axis through said adapter.

10. A dispenser for storing and dispensing multiple rolls of a solid or coreless rolled material, comprising:

a frame having side wall members, a cover, and a dispensing opening, said side wall members having generally vertically oriented and oppositely facing slots defined on inside surfaces thereof;

adapters removably insertable into said slots for holding said rolls therebetween in a vertically aligned orientation within said frame, each of said adapters further comprising a base body having a first side disposable adjacent said roll and a second side disposable adjacent said side wall member;

a protrusion extending substantially transverse from said first side, said protrusion having a shape so as to extend partially into a recess formed in sides of said rolls, and a length so as not to extend into said roll and contact said protrusion of the opposite said adapter;

an engaging member extending substantially transverse from said second side and having a shape and length so as to be insertable into and slidable along said slots;

said base body comprising first and second halves with a spring device disposed therebetween, said second half defining said second side and being spring loaded towards said engaging member so as to act as a bearing surface which slides along structure defining said roll dispenser slots, said engaging member disposable within said slot adjacent an opposite side of said structure; and wherein said adapters engage and hold said rolls therebetween with said rolls being rotatable relative to said adapters so that when a first said roll is depleted, said first halves move inward towards each other thereby preventing said adapters from canting relative to said slot and a second roll moves downward into an aligned position in said dispensing opening by engagement of said engaging members within said slots and rolls against said adapters for said first roll which are retained within said slots.

11. The dispenser as in claim 10, wherein said engaging member is non-movable relative to said first half, said second half being spring loaded against said engaging member.

12. The dispenser as in claim 11, wherein said engaging member comprises a shaft section connected to said first half, said second half concentric about and movable along said shaft section, said engaging member further comprising a flange member configured to slide within said slots.

13. The dispenser as in claim 12, wherein said flange member comprises an oblong member with radiused ends.

14. The dispenser as in claim wherein said protrusion further comprises a rolling surface against which said second roll rolls once said first roll has been depleted.

15. The dispenser as in claim 14, wherein said rolling surface is generally horizontal.

16. The dispenser as in claim 14, wherein said rolling surface is generally conical.

17. The dispenser as in claim 10, wherein said protrusion is essentially coaxial with a longitudinal axis through said adapter.

18. The dispenser as in claim 10, wherein said protrusion is offset from a longitudinal axis through said adapter.

* * * * *